US007185537B2

(12) United States Patent
Muhs

(10) Patent No.: US 7,185,537 B2
(45) Date of Patent: Mar. 6, 2007

(54) NIP AND LOADING ANALYSIS SYSTEM

(75) Inventor: Byron G. Muhs, Janesville, WI (US)

(73) Assignee: Metso Paper, Inc., Helsinki (FI)

( * ) Notice: Subject to any disclaimer, the term of this patent is extended or adjusted under 35 U.S.C. 154(b) by 471 days.

(21) Appl. No.: 10/454,766

(22) Filed: Jun. 4, 2003

(65) Prior Publication Data

US 2004/0244609 A1 Dec. 9, 2004

(51) Int. Cl.
*G01L 5/04* (2006.01)

(52) U.S. Cl. ..... 73/159

(58) Field of Classification Search ..... 73/159
See application file for complete search history.

(56) References Cited

U.S. PATENT DOCUMENTS 4,625,637 A * 12/1986 Pav et al. ..... 100/47
4,644,860 A * 2/1987 Brendel ..... 100/35
4,975,153 A * 12/1990 Nelson et al. ..... 162/358.1
5,048,353 A 9/1991 Justus
5,127,141 A * 7/1992 Roerig et al. ..... 492/7
5,358,606 A 10/1994 Makkonen
5,370,327 A * 12/1994 Adamski ..... 242/533.1
5,379,652 A 1/1995 Allonen
5,381,341 A 1/1995 Herrala et al.
5,383,371 A 1/1995 Laitinen
5,592,875 A 1/1997 Moschel
5,699,729 A 12/1997 Moschel
5,703,574 A 12/1997 Allonen
5,762,759 A * 6/1998 Wedel ..... 162/193
5,785,636 A * 7/1998 Bonander et al. ..... 492/7
5,813,496 A 9/1998 Hyvonen et al.
5,908,537 A * 6/1999 Bentele et al. ..... 162/360.3
5,930,136 A 7/1999 Nakajima et al.
5,953,230 A 9/1999 Moore
6,205,369 B1 3/2001 Moore
6,228,009 B1 * 5/2001 Van Haag ..... 492/7
6,231,722 B1 5/2001 Vestola
6,270,628 B1 8/2001 Suomi et al.
6,423,186 B1 * 7/2002 Trokhan et al. ..... 162/280
6,430,459 B1 8/2002 Moore
6,523,465 B1 * 2/2003 Kayser ..... 100/35
6,662,630 B2 * 12/2003 Onnela et al. ..... 73/37.7
6,669,821 B2 * 12/2003 Edwards et al. ..... 162/358.1
6,685,610 B2 * 2/2004 Holopainen ..... 492/16
6,769,314 B2 * 8/2004 Moore et al. ..... 73/862.55
6,835,283 B2 * 12/2004 Weigant et al. ..... 162/198
6,910,376 B2 * 6/2005 Maenpaa ..... 73/159
2002/0011116 A1 1/2002 Onnela et al.

(Continued)

OTHER PUBLICATIONS

"Loading System condition test and loading system service" Metso Paper brochure, Metso Paper, Inc., Apr. 2001, 2 pp.

(Continued)

*Primary Examiner*—Michael Cygan
*Assistant Examiner*—Octavia Davis
(74) *Attorney, Agent, or Firm*—Stiennon & Stiennon

(57) ABSTRACT

A nip characterization system which has as inputs the pressure applied to the nip by the hydraulic loading devices, and loads applied at the end bearings and/or the loads applied to the roll support beam, and in addition directly measures nip load, has more than sufficient information to completely characterize the nip.

11 Claims, 2 Drawing Sheets

U.S. PATENT DOCUMENTS

2004/0237665 A1* 12/2004 Mucke et al. ..... 73/862.44

OTHER PUBLICATIONS

"NipScan®—The Unique Electronic Shoe Press Nip Impression System" by Paul J. Turner & Peter F. Slater, 88th Annual Meeting, PAPTAC 88e Congrés Annuel, Jan. 28-31, 2002, pp. A63-A65.

"Nip Profile Measurement" web printout from Albany International, http://www.albint.com/web/pmc/belting/belting.nsf/f65da825598004498525689000 6e97cf/ . . . , Apr. 9, 2003, 1 p.

"Nipscan Load Impression" & "Hysteresis Force Measurement of Shoe Nip", printout, 1 p.

"Tests and inspections . . . ", Metso Paper printout, Metso Paper, Inc., Apr. 2001, 1 p.

"Loading system condition test and system service", Metso Paper printout, Metso Paper, Inc., Apr. 2001, 1 p.

"Grounds for service . . . ", Metso Paper printout, Metso Paper, Inc., Apr. 2001, 1 p.

"Shoe press process and condition test and shoe press service", Metso Paper printout, Metso Paper, Inc., Apr. 2001, 1 p.

"Press section process and condition tests and press section services", Metso Paper printout, Metso Paper, Inc., Apr. 2001, 1 p.

* cited by examiner

NIP AND LOADING ANALYSIS SYSTEM

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to papermaking machine elements which are loaded to establish a pressure profile in general and in particular to systems for measuring the pressure profile generated by the element.

In any part of a papermaking machine or paper processing machine, such as a press or calender, where a paper web is passed through a nip formed between two rolls or between a shoe and a backing roll, it is desirable to control the nip pressure in the cross machine direction, and the nip pressure profile in the machine direction. Typically it is desirable to make the nip pressure as uniform as possible in the cross machine direction so that the entire web is uniformly treated. The pressure profile in the machine direction is tailored to achieve optimal results in calendaring or dewatering, or to minimize wear. A uniform nip loading can be accomplished by employing a crowned roll; however, for a given amount of crown, only a single uniform nip loading can be achieved. Oftentimes, as the grade of paper or type of paper changes it is desirable to change the nip loading. Further, as the width of papermaking machines has been increased to as much as ten meters it has become more difficult to achieve uniform loading along the entire cross machine direction length of the nip using simple crowned rolls.

The solution is to use a deflection-compensated roll, sometimes also referred to as a crown control roll. In a deflection-compensated roll, one or more hydraulic pistons is arranged in the cross machine direction within a roll shell. The hydraulic pistons are mounted to a roll support beam. The hydraulic pistons form hydraulic loading devices which directly support the shell by applying load to the inside surface of the roll shell. Deflection-compensated rolls are typically employed in the pressing section of a papermaking machine, or in the rolls of a calender or supercalender. Deflection-compensated rolls require a high capital investment and, to gain full benefit from the investment, it is desirable to control each deflection-compensated roll as accurately as possible.

Deflection-compensated rolls can be divided into rolls with a mobile shell and rolls with a fixed shell. Both types of deflection-compensated roll have a nonrotating support beam about which the roll shell is mounted. The shell may be fixed with respect to the support beam by end bearings which may be roller bearings or hydraulic slide bearings. To close the nip between a deflection-compensated roll which is fixed with respect to a support beam, the entire support beam is moved onto loading arms to close the nip. Alternatively, the roll shell may be radially movable on the support beam with respect to the axis of the shell in the plane defined by the nip and the roll axis so that the nip may be opened and closed by such radial movement.

To determine the cross machine nip load, in a deflection-compensated roll where the roll shell is fixed with respect to the support beam, the total loading of the deflection-compensated roll may be determined by determining the loading of the support beam. Alternatively, or in addition, the loading applied to the roll shell by loads in the end bearings, and in the individual cross machine direction loading devices, can be determined, typically by measuring the hydraulic pressure supplied to the loading devices and end bearings, and calculating load based on the cross-sectional area of the pistons or bearings. Where the roll shell is mounted for radial motion, the nip loads can be determined from the total hydraulic loading of the cross machine direction loading devices.

The pressure in a nip between two rolls has been measured directly by pressure sensors which are placed in the nip as described in U.S. Pat. No. 5,953,230, or by a process known as NipScan® developed by Albany International Corp. of Albany, N.Y. Determining nip pressure or roll bearing loads by any of the foregoing techniques is important because paper quality can depend on nip uniformity. In addition, excess nip loading can damage elastic roll covers which are used to provide a so-called "soft nip". What is needed is a better technique and system for characterizing the nip load formed between two rolls, or between a shoe and a backing roll.

SUMMARY OF THE INVENTION

The nip characterization system of this invention employs sensors which detect the load applied by a series of hydraulic loading devices arrayed in the cross machine direction between a roll shell and a support beam in a deflection-compensated roll, and sensors which, in a fixed shell roll, detect the bearing loads, and the loads in loading arms which support the roll support beam. In a movable shell roll, sensors which detect the loading imposed on a support beam are used. In addition to the load measuring sensors, an array of cross machine direction pressure sensors are placed between the deflection-compensated roll and a backing element. More than sufficient information to completely characterize the nip is provided to a nip analysis system which has as inputs the pressure applied to the nip by the hydraulic loading devices, loads applied at the end bearings or the loads applied to the roll support beam; and, in addition, the nip loads measured with pressure sensors. The redundant information can be used to better characterize the nip loading and the cause of any irregularities in the nip loading.

It is a feature of the present invention to provide at least two measurements which are diagnostic of the nip loading between a deflection-compensated roll and a backing roll.

It is another feature of the present invention to provide a technique for better assessing the cross machine direction nip loading profile, and the source and possible solution to any undesirable variation in nip loading.

Further objects, features and advantages of the invention will be apparent from the following detailed description when taken in conjunction with the accompanying drawings.

DESCRIPTION OF THE PREFERRED EMBODIMENTS

Figure 1:
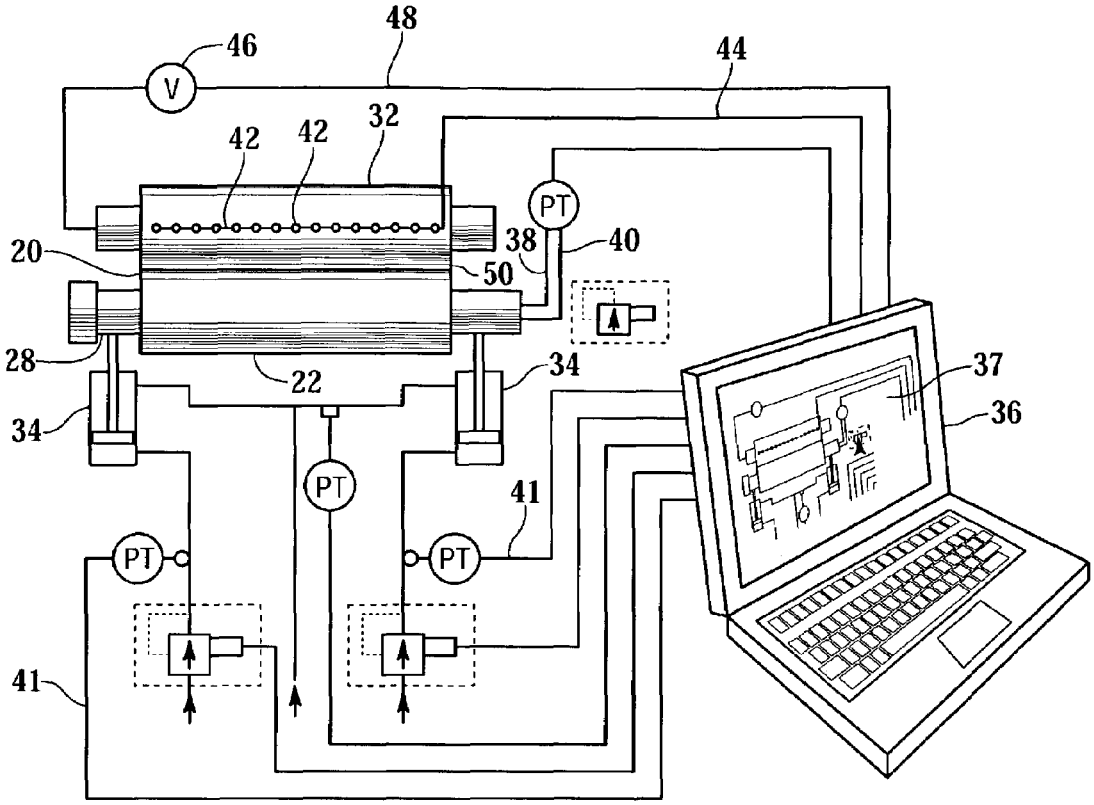
FIG. 1 is a schematic view of a deflection-compensated roll forming a nip with a backing roll in which several nip characterizing parameters are simultaneously measured.
Figure 2:
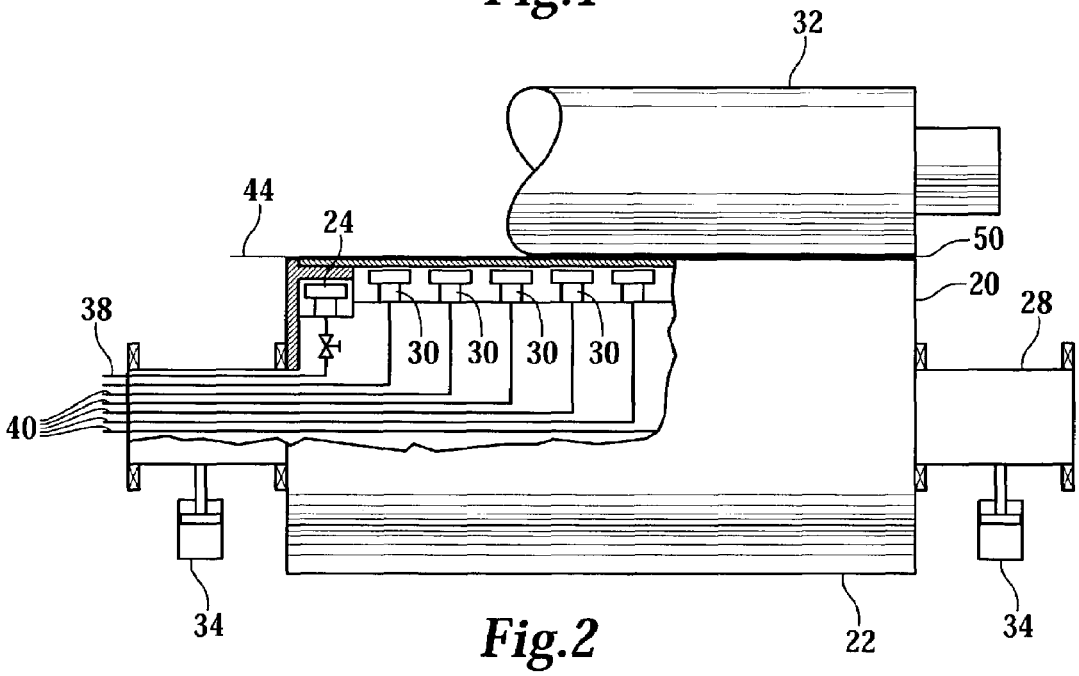
FIG. 2 is a side elevational view, partially cut away in section, of the deflection-compensated roll of FIG. 1.
Figure 3:
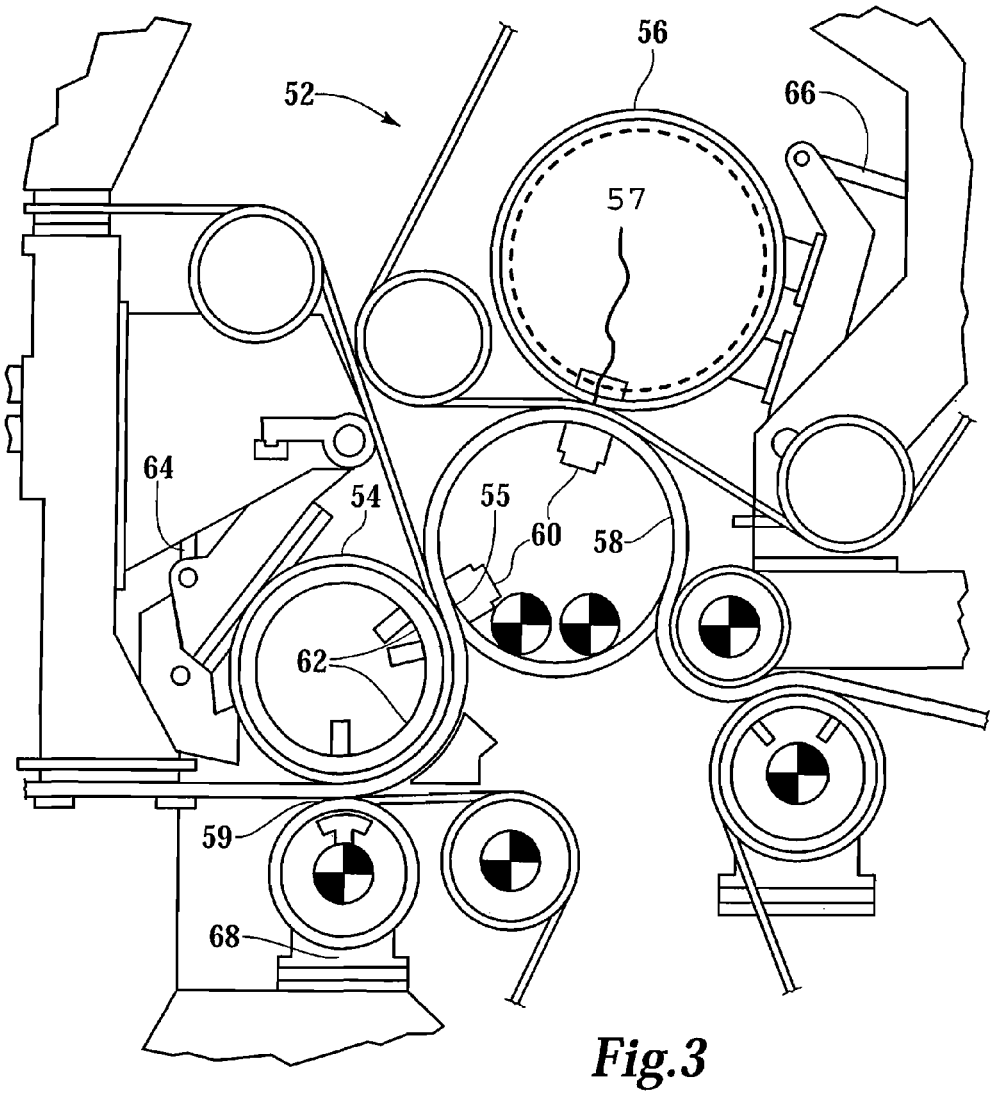
FIG. 3 is a schematic side elevational view of a multi-nip pressing section on which several nip characterizing parameters are simultaneously measured.

Referring more particularly to FIGS. 1–3, wherein like numbers refer to similar parts, a deflection-compensated roll 20 is shown in FIGS. 1 and 2. The deflection-compensated roll 20 has a roll shell 22 which is supported at its ends by hydraulic slide bearings 24 on a roll support beam 28. A plurality of hydraulic loading devices 30 extend between the roll shell 22 and the roll support beam 28 and are used to support the roll shell 22 so that the nip loading between the roll shell 22 and a backing roll 32, or other backing element such as a shoe, can be controlled. The roll support beam 28 is mounted to loading arms 34 represented as hydraulic pistons in FIGS. 1 and 2.

A computer 36, data acquisition devices, or other type of controller, with a display system 37 is used to monitor the loads applied by the loading arms 34 to the support beam 28 and the loads applied to the roll shell 22. The hydraulic pressure measurements PT are taken from pressure lines 38 which communicate with the roll end slide bearings 24. Hydraulic measurements are taken from pressure lines 40 which communicate with each of the plurality of hydraulic loading devices 30, and hydraulic measurements are taken from pressure lines 41 which communicate with each of the loading arms 34. U.S. Patent publication No. 2002/0011116A1, which is incorporated herein by reference, describes in more detail how pressure measurements with respect to internal hydraulic elements can be made external to a deflection-compensated roll. In addition to the foregoing loading data, the computer 36 is simultaneously connected to a system 44 which directly measures the cross machine direction nip profile. This system may be a series of piezoelectric pressure sensors 42 which are arrayed in the cross machine direction. Further, if the backing roll 32 is a vacuum roll, the vacuum level 46 can also be measured through a sensor line 48 which transmits vacuum levels to the computer 36. If the vacuum roll has one or more suction glands the vacuum level from each suction gland can be measured as a separate input to the computer 36.

FIG. 1 for illustrative purposes shows the piezoelectric sensors 42 positioned above a nip 50 formed between the roll shell 22 and a backing roll 32. In use, the piezoelectric sensors 42 are positioned in the nip 50, as shown in FIG. 2. The piezoelectric sensors 42 measure actual nip loading in the cross machine direction, thus effectively measuring the loading imposed by the mounting arms 34, the hydraulic loading devices 30, and the hydraulic slide bearings 24. Moreover, each of the foregoing loading mechanisms can be varied one at a time while the amount of applied load is measured and compared to the actual nip loads developed in the cross machine direction. In this way an empirical relationship between applied loads and measured actual loads can be developed. This measured relationship can be compared to the control laws, and constants or parameters used in the control of the deflection-compensated roll 20 can be modified based on the data taken. Further, by varying a single parameter, diagnostics on the functionality of the loading mechanisms can be performed.

If a self-loading deflection-compensated roll is employed, pressure data can be taken from the hydraulic loading devices and from load cells, air rides, or strain gauges positioned to determine the loading on the associated load support beam. If the backing roll 32 is a vacuum roll, the vacuum can be measured and changes in the amount of vacuum can also be correlated with measured nip loads.

The benefit of combining actual nip loading data with applied nip pressure data is better characterization of a deflection-compensated roll, both for diagnosing problems and for improving the control of the nip pressure in the cross machine direction.

As illustrated in FIG. 3, a pressing section 52 of the papermaking machine has a first press roll 54, forming a first press nip 55 with a single roll 58, and a second press roll 56 forming a second press nip 57 with the single roll 58. The single roll 58 has internal hydraulic roll supports 60. The apparatus and method of this invention can be used to characterize all of the nips in a multi-nip press 55, 57, and 59, simultaneously monitoring the pressure in each section 62 of the vacuum roll 54 and the hydraulic loading within each roll 56, 58, and the loading applied to roll support arms 64, 66, 68 in addition to directly measuring nip forces with sensors (not shown) placed between nips 55, 57, 59.

It should be understood that the techniques for measuring actual nip pressure are not limited to the use of piezoelectric sensors—other types of sensors or sensor systems, for example fiber-optic sensors, could be used. The NipScan® system from Albany International could also be used to determine nip pressure directly.

It is understood that the invention is not limited to the particular construction and arrangement of parts herein illustrated and described, but embraces all such modified forms thereof as come within the scope of the following claims.

I claim:

1. A method of characterizing a deflection-compensated roll comprising the steps of:

measuring nip forces with a plurality of nip force sensors positioned in a nip between a deflection-compensated roll shell and a backing element, wherein the deflection-compensated roll shell is mounted about a support beam;

urging the support beam toward the backing element, and simultaneously measuring loads applied by loading arms to urge the support beam towards the backing element;

measuring hydraulic pressure from internal to the roll shell, wherein the measured hydraulic pressure is used to support one or more pistons which operate to support the roll shell; and displaying on a display screen at least one value from; the plurality of nip force sensors, from the measured loads applied to loading arms, and from the measured hydraulic pressure from internal to the roll shell.

2. The method of claim 1 wherein the step of simultaneously measuring hydraulic pressure from internal to the roll shell includes measuring the loads applied to the shell of the deflection-compensated roll by a plurality of cross machine direction arrayed hydraulic loading devices positioned between the support beam and the deflection-compensated roll shell.

3. The method of claim 1 wherein the step of simultaneously measuring hydraulic pressure from internal to the roll shell includes measuring the loads applied by end hydraulic slide bearings which support the roll shell on the support beam.

4. The method of claim 1 wherein the backing element is a vacuum roll, and further comprising the step of measuring and displaying the vacuum pressure.

5. A method of characterizing a deflection-compensated roll comprising the steps of:

measuring nip forces with a plurality of nip force sensors positioned in a nip between a deflection-compensated roll shell and a vacuum roll, wherein the deflection-compensated roll shell is mounted about a support beam;

measuring hydraulic pressure from internal to the roll shell, the measured hydraulic pressure used to support one or more pistons which operate to support the roll shell; and measuring the vacuum pressure of the vacuum roll; and displaying on a display screen at least one value from: the plurality of sensors, the measured hydraulic pressure internal to the roll shell, and the vacuum pressure.

6. A method of characterizing a self-loading deflection-compensated roll comprising the steps of:

measuring nip forces with a plurality of nip force sensors positioned in a nip between a deflection-compensated roll shell and a backing element;

measuring hydraulic pressure from internal to the roll shell, the measured hydraulic pressure supporting one or more pistons which operate to support the roll shell and to move the shell into engagement with the backing element; and displaying on a display screen measured values from the plurality of nip force sensors, and from the measured hydraulic pressure internal to the roll shell.

7. The method of claim 6 wherein the backing element is a vacuum roll, and further comprising the step of measuring and displaying the vacuum pressure.

8. A method of characterizing a self-loading deflection-compensated roll comprising the steps of:

measuring nip forces with a plurality of nip force sensors positioned in a nip between a deflection-compensated roll shell and a vacuum roll; and measuring hydraulic pressure from internal to the roll shell, the measured hydraulic pressure supporting one or more pistons which operate to support the roll shell and to move the shell into engagement with the backing element;

measuring the vacuum pressure of the vacuum roll; and displaying on a display screen at least one value selected from the group consisting of: the measured nip forces of the plurality of nip force sensors, the measured hydraulic pressure internal to the roll shell, and the vacuum pressure.

9. A method of characterizing a multi-nip board/paper press comprising the steps of:

measuring the nip force with a plurality of nip force sensors positioned between and engaged with a first roll forming a first nip with a single roll, and measuring the nip force with a second plurality of nip force sensors positioned between and engaged with a second roll forming a second nip with the single roll; and measuring hydraulic pressure internal to the single roll which supports said first nip and measuring hydraulic pressure internal to the single roll which supports said second nip.

10. The method of claim 9 wherein one of said first nip and said second nip is formed by a vacuum roll engaged with the single roll, and further comprising the step of measuring the vacuum within the vacuum roll applied at least to one of said first nip and said second nip.

11. The method of claim 9 further comprising measuring at least one pressure which is applied external to at least one of said single roll, said first roll, and said second roll.

* * * * *